United States Patent [19]

Bente

[11] 4,447,971

[45] May 15, 1984

[54] FOOTBALL BOOT

[75] Inventor: Alfred Bente, Herzogenaurach, Fed. Rep. of Germany

[73] Assignee: Messrs. Adidas Sportschuhfabriken Adi Dassler AG, Fed. Rep. of Germany

[21] Appl. No.: 350,157

[22] Filed: Feb. 19, 1982

[30] Foreign Application Priority Data

Feb. 25, 1981 [DE] Fed. Rep. of Germany ... 8105234[U]

[51] Int. Cl.[3] ..... A43B 5/02

[52] U.S. Cl. ..... 36/133; 36/128

[58] Field of Search ..... 36/133, 128

[56] References Cited

U.S. PATENT DOCUMENTS 3,525,165 8/1970 Randall ..... 36/133

4,204,346 5/1980 Fugere ..... 36/133

FOREIGN PATENT DOCUMENTS 2255628 5/1974 Fed. Rep. of Germany ..... 36/133

*Primary Examiner*—Patrick D. Lawson

[57] ABSTRACT

A football boot is provided on its upper portion with strips of leather or like material which extend transversely over the instep of the boot thereby to enhance the frictional contact with a ball to be controlled with the foot. The strips are connected to the boot in such a way that at least the forward edges of the strips can lift away from the upper portion of the boot.

11 Claims, 2 Drawing Figures

FOOTBALL BOOT

BACKGROUND OF THE INVENTION

The present invention relates to a football boot and more particularly a football boot having projections on the outside of the upper portion thereof, for enhancing frictional contact with a ball to be controlled with the boot.

The expression football boot is used in this specification to denote any sports boot or shoe for playing games involving moving a ball of any type and shape by means of the foot, even if the foot is not always the main agent throughout the game for moving the ball, thus including for example American Football. The term boot is used to cover the modern kind of football footwear which often shows a trend towards a lighter boot construction by approaching the lower format of a shoe, rather than the higher build of a conventional design of boot.

There are already a number of football boots which have friction-enhancing projections on the outside of the upper portion thereof, in order thereby to improve contact with the ball and to enable the football player to impart considerable effects to the ball and thereby for example to strike the ball in a curve. Such boot designs include arranging for conical or hemispherical projections comprising for example rubber to project through holes in the upper portion of the boot (see for example German Utility Model No 18 37 884), providing a coating of plastic material or rubber with knobs on the outside of the upper portion of the boot, or impregnating or causing pitting or pocking in the outside surface of the upper portion of the boot (see German Utility Model No 69 18 326), or arranging special sheets of rubber on the boot upper (see for example German laid-open application DOS No 26 52 055). If such designs have been put to practical use, they have only achieved partial success. For example, under wet conditions, when good contact with the ball is most required, rubber knobs become substantially useless, while pocking or roughening up the surface of the leather loses its effectiveness after just a short period of time, due to mud and dirt inevitably accumulating in the recesses formed by the pocking or roughening, thus resulting in the outside surface of the boot upper becoming smooth.

SUMMARY OF THE INVENTION

An object of the present invention is to provide a football boot design which provides for improved contact with a ball to be controlled by the boot, to permit enhanced ball control.

A further object of the present invention is to provide a football boot which has friction-enhancing means for improving contact with the ball to be controlled, such means having an improved length of operating life.

Still another object of the present invention is to provide a football boot having friction-enhancing means to permit improved ball control, which involves only a sewing operation in applying the friction-enhancing means.

A still further object of the present invention is to provide a football boot with friction-enhancing means, which give a self-cleaning effect.

Yet another object of the present invention is to provide a football boot which gives improved contact with a ball to be controlled thereby, even under wet conditions.

According to the present invention, these and other objects are achieved by means of a football boot, as defined hereinbefore, which has raised means on the upper portion of the boot, more particularly in the instep region and also in part in the toe region, which are adapted to enhance frictional contact with the ball to be controlled. The raised means comprise one or more strips of a tough material such as leather or the like, which extend substantially transversely over the upper portion of the boot in the instep and/or toe region and which are connected to the boot upper by a connection such as a seam which is spaced from the forward edge of the respective strip, in such a way as to permit the forward edge of the strip to lift away from the surface of the boot.

The leather strip or strips may be for example from 3 to 5 mm in width, and are joined to the upper portion of the boot, for example by sewing, in the vicinity of the edge of the strip or strips which is towards the rear of the boot. In this way, the front edge region of the or each strip can lift away from or stand up on the upper portion of the boot. When therefore a player wearing the boot strikes the ball, with initially a relative movement between the boot and the ball when the outside surface of the upper portion of the boot hits against the surface of the ball, then, in the majority of possible forms of striking the ball with the foot, that relative movement causes the forward edge portion of each of the strips to stand up so that the strips bear against the surface of the ball, with their underside. This effect of the front longitudinal edge of the or each strip standing up means on the one hand that each strip forms an almost scraping contact with the surface of the ball, thereby enhancing the player's possibility of controlling the ball in the appropriate fashion, while on the other hand the edge of the or each strip is also moved relative to the outside surface of the boot upper portion, thereby removing any mud or dirt or the like which may possibly be present on the boot at that point. This therefore means that the functional capability and efficiency of the leather strip or strips is not generally detrimentally affected by the accumulation of mud, and the effective edge of the or each strip therefore retains its effect over a prolonged period of time.

The or each leather strip may be joined for example by sewing to the upper portion of the boot, along the centreline of the respective strip, in such a way that both the front and rear edge portions of the or each strip can lift away from the surface of the boot. This would mean that both longitudinal edges of the strips are effective in the manner described above, so that the boot will also have the effect of gripping the ball, to give improved ball control, in situations of striking the ball in which the boot moves rearwardly relative to the surface of the ball as it is struck.

It may also be desirable for the underside of the or each leather strip to be of a rough nature as that will further improve the frictional contact with the surface of the ball.

It has been found that even wet conditions do not have a detrimental effect on the functional capability and efficiency of the leather strips as, particularly when the underside of the strips is rough, the edge region of the strips produces a certain wiping effect.

Other objects, features and advantages of the present invention will be apparent from the detailed description hereinafter.

DESCRIPTION OF THE PREFERRED EMBODIMENT

Figures 1, 2:
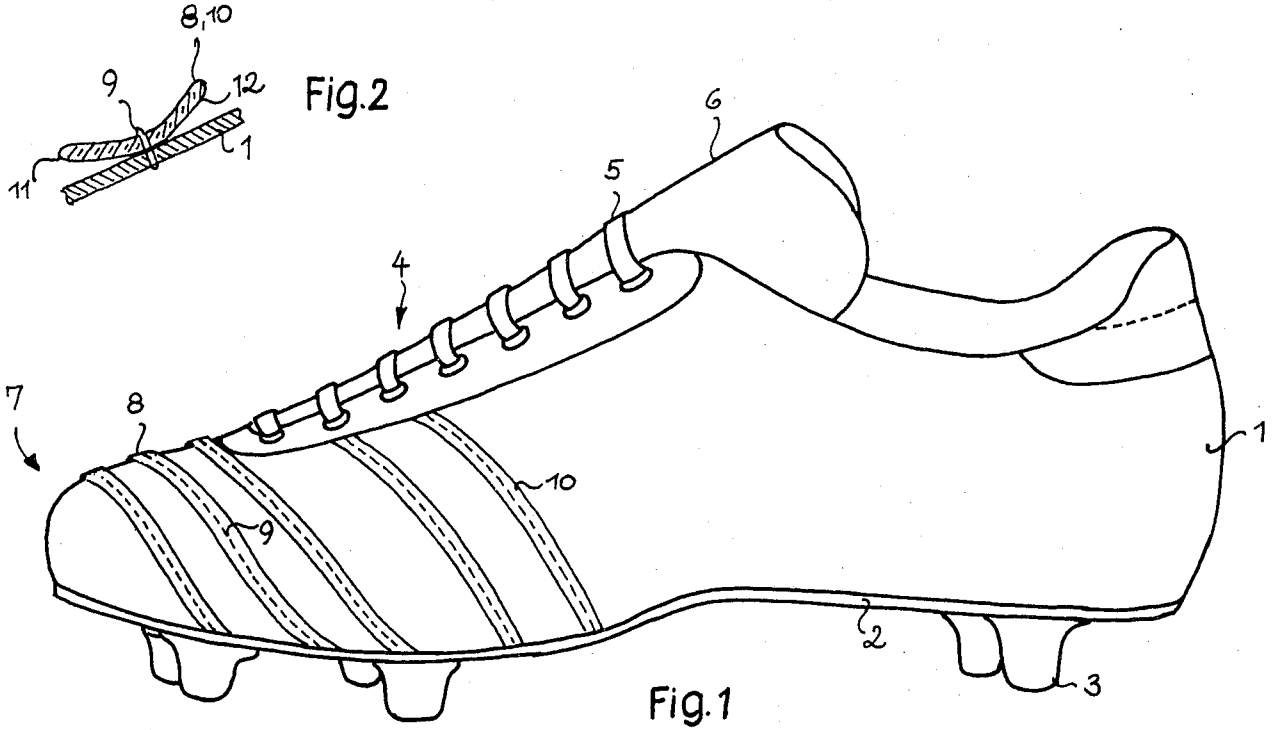
FIG. 1 shows a view onto the outside of a football boot designed in accordance with the principles of this invention.
FIG. 2 shows a view on a larger scale of one manner of securing a leather strip to the outside of the upper portion of the boot.

Referring firstly to FIG. 1, shown therein is a football boot which is of a generally conventional design, comprising an upper portion 1 of leather, artificial leather or plastic material, a sole 2 which preferably comprises a rigid plastic material, for example nylon, and ground-engaging means illustrated in the form of knobs or studs 3, although bars or other suitable configurations may alternatively be employed, which are replaceably or non-releasably joined to the sole 2. The boot upper portion has the usual foot entry opening which also extends along a part of the instep region as indicated at 4, and can be closed by a lace 5 and a tongue 6.

The toe region of the boot is indicated by reference numeral 7 in FIG. 1.

The boot also has a plurality of projections on the surface of the upper portion of the boot, to enhance frictional contact with a ball to be controlled by means of the foot, as will now be described in greater detail. Referring still therefore to FIG. 1, the friction-enhancing projections comprise at least one and as illustrated preferably a plurality of strips 8 of a tough material such as leather or the like, which extend substantially parallel and at a certain distance from each other, transversely to the longitudinal direction of the boot, over the instep region at 4 and over part of the toe region at 7. The strips 8 are secured to the surface of the upper portion 1 of the boot by a connecting means which is spaced from the forward edge of the respective strips and preferably along the longitudinal centreline of each strip, as indicated at 9. The connecting means may be for example in the form of a sewn seam. As can be clearly seen from FIG. 1, the strips 8 extend down the sides of the boot, to the edge or welt of the sole 2. The strips 8 also extend down to the edge of the sole 2 on the opposite side of the boot, which is not visible in FIG. 1, that is to say, on the inside part of the boot in the area where the ball of the foot lies. It will also be seen from FIG. 1 that the strips are arranged at the sides of the boot in such a way as to extend downwardly at an inclined angle rearwardly.

It will further be seen from FIG. 1 that the boot has further strips 10 which extend from the lace opening of the upper portion of the boot, at an inclined angle rearwardly, being connected to the upper portion 1 of the boot also by a longitudinal centre seam in each strip. Corresponding strips 10 are also to be found on the inward side of the boot which is not visible in FIG. 1.

In the illustrated embodiment, there are three leather strips 8 which extend one beside the other over the instep region of the upper portion of the boot, and two leather strips 10 which are in the lateral ball regions of the boot. The spacing of the leather strips is for example from approximately 1.5 to 2 cm; the width of the strips is for example about 5 mm. It will be appreciated that the spacing and width of the strips may deviate from the above-indicated dimensions, provided that the effect of the edge regions of the strips 8 and 10 lifting away from the surface of the boot and thus standing up to give enhanced frictional contact with the ball, is still produced. Further reference to this aspect will be made below.

FIG. 2 shows a view on an enlarged scale of one method of securing the strips 8 and 10 to the outside of the upper portion of the boot. It will be seen from FIG. 2 that, as a result of the leather strips 8 and 10 being connected to the upper portion of the boot along their longitudinal centreline, or substantially thereat, as by the seam 9, the edge regions 11 and 12 of the strip tend to stand up somewhat from the moment that they are secured in that manner, as the strips 8 and 10 tend to be curved somewhat transversely with respect to their longitudinal direction, by virtue of being pressed against the outside surface of the boot by the seam 9. This tendency of the edge regions 11 and 12 to stand up from the outset promotes the above-discussed effect of the edge regions being tilted or bent over on making contact with the ball, thereby giving the enhanced frictional contact and thus better ball control.

Instead of the strips 8 and 10 being joined to the boot by means of a seam as in the illustrated embodiment, the strips may also be joined to the upper portion of the boot by adhesive means along their central region or their rearward edge region. Furthermore, instead of using leather for the strips 8 and 10, it would be possible to use for example a plastic material which has the same effect and which absorbs moisture in the same manner as leather and which has for example a surface which is comparable to the flesh-ward side of leather.

The underside of the leather strips 8 and 10 is of a rough nature, while the upper or outward side thereof may be of the same surface structure and colour as the upper portion 1 of the boot.

It has been found that the most suitable leather for the leather strips is kangaroo leather which is for example from 1 to 1.3 mm in thickness, with a strip width of from 3.5 to 5 mm. However, it is also possible to use a synthetic leather which is similar to natural leather in regard to moisture absorption, softness and surface structure.

Instead of providing a single substantially central seam 9, it may be advantageous to use two central seams 9 for securing the strips 8 and 10 in place, as a comparatively vigorous shearing effect is applied to the strips 8 and 10.

Various modifications and alterations may be made in the boot construction described and illustrated herein, without thereby departing from the spirit and scope of the present invention.

What is claimed is:

1. A football boot comprising friction-enhancing projections on the outside of the upper portion of the boot, to enhance frictional contact with a ball, wherein the projections are formed by strips of leather or the like material, which extend transversely over the instep of the upper portion of the boot and which are joined to the upper portion of the boot in such a way that at least the forward edge regions thereof can lift away from the upper portion of the boot.

2. A football boot as set forth in claim 1 wherein leather strips are also provided in the outside and inside ball regions.

3. A football boot as set forth in claim 1 wherein the leather strips are joined to the boot upper portion along their longitudinal centre in such a way that both edge regions thereof can lift away from the upper portion of the boot.

4. A football boot as set forth in claim 1 wherein the leather strips are sewn to the boot upper portion.

5. A football boot as set forth in claim 1 wherein the leather strips extend to opposite edges of the boot sole.

6. A football boot as set forth in claim 5 wherein the leather strips extend at an inclined angle rearwardly from the instep of the boot upper portion.

7. A football boot as set forth in claim 1 wherein the side of the strips which is towards the boot surface is rough.

8. A football boot as set forth in claim 1 wherein each said strip is about 5 mm in width and about 1 mm in thickness.

9. A football boot comprising a sole, an upper portion including a forward part forming a toe region and an instep region and joined to the sole, and raised means on the upper portion adapted to enhance frictional contact with a ball to be controlled by the boot, comprising at least one strip of tough material extending substantially transversely over said forward part of said upper portion and connected to said upper portion by a connecting means spaced from the forward edge of said at least one strip such as to permit said forward edge to lift away from said upper portion.

10. A football boot as set forth in claim 9 wherein said at least one strip is connected to said upper portion by a seam extending substantially centrally along said strip.

11. A football boot as set forth in claim 9 and further including at least one said strip in the outer and inner ball regions of the boot.

* * * * *